US009737979B1

(12) United States Patent
Sungkhaphong et al.

(10) Patent No.: US 9,737,979 B1
(45) Date of Patent: Aug. 22, 2017

(54) VACUUM EMBEDDED BIT FOR SCREW DRIVERS

(71) Applicant: Western Digital Technologies, Inc., Irvine, CA (US)

(72) Inventors: Komgrit Sungkhaphong, Bangkok (TH); Chalermpon Jaisorn, Lampang (TH)

(73) Assignee: Western Digital Technologies, Inc., San Jose, CA (US)

( * ) Notice: Subject to any disclaimer, the term of this patent is extended or adjusted under 35 U.S.C. 154(b) by 250 days.

(21) Appl. No.: 14/247,498

(22) Filed: Apr. 8, 2014

Related U.S. Application Data

(60) Provisional application No. 61/939,672, filed on Feb. 13, 2014.

(51) Int. Cl.
*B25B 23/08* (2006.01)

(52) U.S. Cl.
CPC ..... *B25B 23/08* (2013.01)

(58) Field of Classification Search
CPC ..... B25B 23/08; B23P 19/005; B23P 19/006
USPC ..... 81/451, 430
See application file for complete search history.

(56) References Cited

U.S. PATENT DOCUMENTS 2,764,197 A * 9/1956 Torresen ..... B25B 15/005 411/404
3,275,047 A * 9/1966 Kulman ..... B25B 23/08 81/451
3,583,451 A 6/1971 Dixon et al.
4,922,436 A 5/1990 Dohm et al.
4,924,732 A 5/1990 Hoskins et al.
6,049,973 A 4/2000 Frank, Jr. et al.
6,223,634 B1 * 5/2001 Hughes ..... B25B 15/005 411/404
6,418,818 B1 7/2002 Tham et al.
6,467,153 B2 10/2002 Butts et al.
6,651,192 B1 11/2003 Viglione et al.
6,657,801 B1 12/2003 Chue et al.
6,687,093 B1 2/2004 Butler et al.
6,751,041 B1 6/2004 Codilian et al.
6,788,480 B1 9/2004 Codilian et al.
6,791,782 B1 9/2004 Codilian et al.
(Continued)

OTHER PUBLICATIONS

David Wuester, Sr., et al., U.S. Appl. No. 13/098,278, filed Apr. 29, 2011, 21 pages.

(Continued)

*Primary Examiner* — Hadi Shakeri

(57) ABSTRACT

An apparatus for driving fasteners includes a rotatable bit having a bit tip mateable with a fastener, a vacuum source, and a rotatable sleeve having an outlet in communication with the vacuum source. The bit may be press fit within the sleeve such that the bit and the sleeve are rotatable together. Aspects of a method of rotating a fastener with a apparatus for driving fasteners, the apparatus for driving fasteners having a rotatable bit having a bit tip, and a rotatable sleeve having an outlet, wherein the bit is press fit within the sleeve such that the bit and the sleeve are rotatable together, the method including providing a vacuum to the outlet of the sleeve, engaging the bit tip and the sleeve with the head of the screw with assistance from the vacuum, and rotating the bit, thereby rotating the sleeve and the fastener.

13 Claims, 7 Drawing Sheets

(56) References Cited

U.S. PATENT DOCUMENTS 6,792,669 B2 9/2004 Codilian
6,798,592 B1 9/2004 Codilian et al.
6,894,861 B1 5/2005 Codilian et al.
6,897,393 B1 5/2005 Codilian et al.
6,898,044 B1 5/2005 Chheda
6,943,972 B1 9/2005 Chue et al.
7,003,626 B1 2/2006 Chheda et al.
7,027,242 B1 4/2006 Terrill et al.
7,046,467 B1 5/2006 Chheda
7,058,759 B1 6/2006 Reiser et al.
7,072,129 B1 7/2006 Cullen et al.
7,076,391 B1 7/2006 Pakzad et al.
7,076,603 B1 7/2006 Chheda
7,136,242 B1 11/2006 Chue et al.
7,139,145 B1 11/2006 Archibald et al.
7,145,744 B1 12/2006 Clawson et al.
7,147,421 B2 * 12/2006 Suzuki ..... F16B 23/003 411/404
7,178,432 B1 2/2007 Han et al.
7,199,959 B1 4/2007 Bryant
7,203,020 B1 4/2007 Viglione et al.
7,209,310 B1 4/2007 Tsai et al.
7,222,410 B1 5/2007 Klassen et al.
7,236,911 B1 6/2007 Gough et al.
7,269,525 B1 9/2007 Gough et al.
7,458,282 B1 12/2008 Wuester, Sr. et al.
7,490,398 B1 2/2009 Klassen et al.
7,506,553 B1 3/2009 Panyavoravaj
7,549,204 B1 6/2009 Vangal-Ramamurthy et al.
7,552,526 B1 6/2009 Klassen et al.
7,559,590 B1 7/2009 Jones
7,561,416 B1 7/2009 Sarraf
7,596,722 B1 9/2009 Pakzad et al.
7,634,375 B1 12/2009 Pakzad et al.
7,653,983 B1 2/2010 Klassen
7,669,711 B1 3/2010 Westwood
7,671,599 B1 3/2010 Tan et al.
7,673,638 B1 3/2010 Boynton et al.
7,690,705 B1 4/2010 Roberts et al.
7,743,486 B1 6/2010 Klassen et al.
7,863,889 B1 1/2011 Bamrungtham
7,869,182 B1 1/2011 Tan et al.
7,869,183 B1 1/2011 Tan et al.
7,874,424 B1 1/2011 Westwood
7,896,218 B2 3/2011 Rakpongsiri et al.
7,900,272 B1 3/2011 Tan et al.
7,912,666 B1 3/2011 Pakzad et al.
7,916,599 B1 3/2011 Panyavoravaj et al.
7,921,543 B2 4/2011 Trongjitwikrai et al.
7,930,955 B2 4/2011 Miyamoto
7,940,487 B1 5/2011 Krishnan et al.
7,974,038 B2 7/2011 Krishnan et al.
7,980,159 B1 7/2011 Han
7,987,585 B1 8/2011 Klassen et al.
7,997,164 B2 8/2011 Miyamoto
8,066,171 B1 11/2011 Rakpongsiri et al.
8,078,421 B1 12/2011 Shastry et al.
8,092,610 B1 1/2012 Tarrant
8,094,414 B1 1/2012 Cheng et al.
8,098,460 B1 1/2012 Jen et al.
8,127,643 B1 3/2012 Tan
8,135,208 B1 3/2012 Vangal-Ramamurthy
8,162,366 B1 4/2012 Tan et al.
8,168,033 B1 5/2012 Mohamad Nor
8,180,487 B1 5/2012 Vangal-Ramamurthy et al.
8,199,425 B1 6/2012 Gustafson et al.
8,218,256 B1 7/2012 Lin et al.
8,223,448 B1 7/2012 Haw et al.
8,230,570 B1 7/2012 Choong
8,245,601 B1 8/2012 Hastama et al.
8,267,831 B1 9/2012 Olsen et al.
8,270,118 B1 9/2012 Cheng et al.
8,300,338 B1 10/2012 McFadyen
8,307,537 B1 11/2012 Klassen et al.
8,312,585 B1 11/2012 Tarrant
8,322,235 B1 12/2012 Keopuang et al.
8,327,529 B1 12/2012 Tan et al.
8,335,049 B1 12/2012 Liu et al.
8,345,367 B1 1/2013 Tharumalingam
8,347,766 B2 * 1/2013 Ota ..... B23P 19/003 81/430
8,356,384 B1 1/2013 Ferre et al.
8,369,073 B2 2/2013 Trinh et al.
8,379,363 B1 2/2013 Kolunthavelu et al.
8,387,631 B1 3/2013 Thonghara et al.
8,424,418 B1 4/2013 Wuester, Sr. et al.
8,424,824 B1 4/2013 Tan et al.
8,432,630 B1 4/2013 Lin et al.
8,432,631 B1 4/2013 Lin et al.
8,447,430 B1 5/2013 Tan et al.
8,447,551 B1 5/2013 Ong et al.
8,451,578 B1 5/2013 Tan et al.
8,453,841 B1 6/2013 James et al.
8,454,755 B1 6/2013 Tan et al.
8,485,772 B1 7/2013 Ismail et al.
8,493,681 B1 7/2013 Selvaraj
8,537,480 B1 9/2013 Haw
8,544,164 B1 10/2013 Cheng et al.
8,547,657 B1 10/2013 Liu et al.
8,553,968 B1 10/2013 Lee et al.
8,561,285 B1 10/2013 Vangal-Ramamurthy et al.
8,565,511 B1 10/2013 Sungkhaphong et al.
8,582,229 B1 11/2013 Krishnan
8,596,107 B1 12/2013 Wongdao et al.
8,605,383 B1 12/2013 Wang et al.
8,640,328 B1 2/2014 Yow et al.
8,650,716 B1 2/2014 Methe et al.
8,653,824 B1 2/2014 Liu et al.
8,662,554 B1 3/2014 Srisupun et al.
8,683,676 B1 4/2014 Wuester, Sr. et al.
8,689,433 B1 4/2014 Choong
2008/0084630 A1 4/2008 Trongjitwikrai et al.
2009/0157848 A1 6/2009 Khoo
2010/0108256 A1 5/2010 Roajanasiri et al.
2013/0057986 A1 3/2013 Vangal-Ramamurthy et al.
2013/0248545 A1 9/2013 Thongjitti et al.

OTHER PUBLICATIONS

Yimin Guo., et al., U.S. Appl. No. 13/607,593, filed Sep. 7, 2012, 18 pages.

* cited by examiner

VACUUM EMBEDDED BIT FOR SCREW DRIVERS

CROSS-REFERENCE TO RELATED APPLICATION

This application claims the benefit of U.S. Provisional Application Ser. No. 61/939,672, filed on Feb. 13, 2014, which is expressly incorporated by reference herein in its entirety.

BACKGROUND

Conventional vacuum-assisted screw driving tools or hand tools often have a screw driver coupled with a screw finder and a driver bit. Generally, in conventional vacuum-assist screw driving tools, the vacuum flow is applied to screw finder, which assists in picking up a screw.

BRIEF DESCRIPTION OF THE DRAWINGS

Various aspects of the present invention will now be presented in the detailed description by way of example, and not by way of limitation, with reference to the accompanying drawings, wherein.

DETAILED DESCRIPTION

Figure 1:
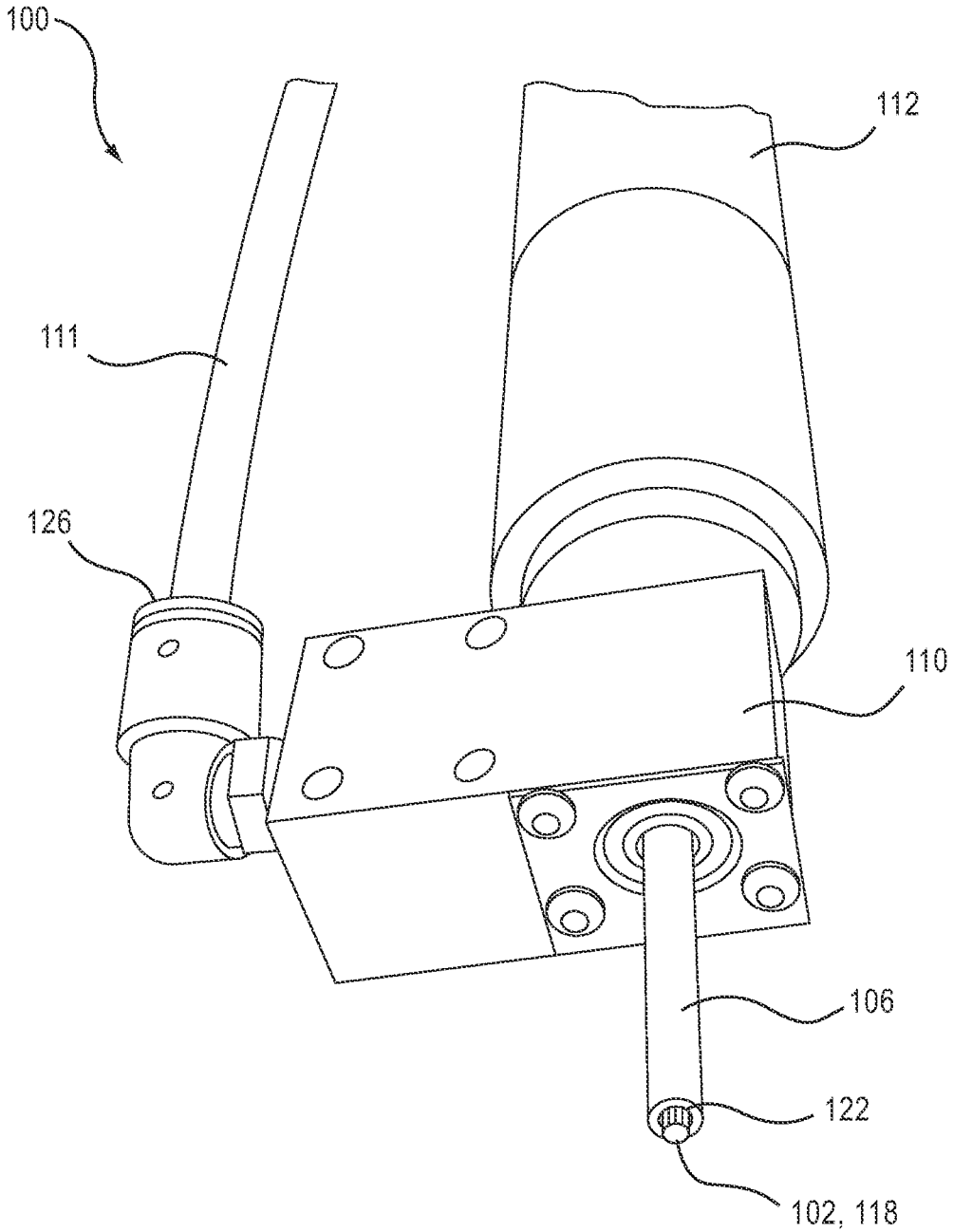
FIG. 1 is a perspective view of an exemplary embodiment of an apparatus for driving fasteners.

The design of the screw finder may vary depending on the particular application. The screw finder serves the function of picking up and holding the screw in a straight orientation to ensure proper screwing or unscrewing into/out of the receiving threads of a work piece.

A disadvantage of using a screw finder to pick up and hold a screw is that the screw finder requires a relatively significant amount space. For example, for a M1 (2 mm head) or M2 (4 mm head) screw, the screw finder may have a wall thickness of about 2 mm. Thus, the total outer diameter of a screw finder, sufficiently large enough to retain a 4 mm screw would be about 8 mm (e.g., 2 mm of thickness surrounding a 4 mm diameter screw). In some instances clearance is required as well. Thus, a screw driver with a screw finder with 2 mm wall thickness may only operate in a space of 8-10 mm or larger. The space requirement of the screw finder is too great in certain applications, such as when the position of the screw in a work piece is too deep and too small for the screw finder to reach. Furthermore, using a screw finder causes scratches on the screw. In use, the top surface of the screw head will contact the shoulder of the pocket of the screw finder. When screwing or unscrewing, the bit engaged with the screw will rotate, thereby rotating the screw. However, the screw finder does not rotate. Thus, during screwing and unscrewing, some or all of the top surface of the screw head will scratch against the shoulder of the pocket of the screw finder. Scratching causes metal particle contamination which should be avoided in certain applications, for example, when manufacturing hard drives.

Thus, there is a need in the art for an improved fastener driving tool having the ability to pick and hold a fastener in small spaces and without scratching the fastener.

The detailed description set forth below in connection with the appended drawings is intended as a description of various exemplary embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention. Acronyms and other descriptive terminology may be used merely for convenience and clarity and are not intended to limit the scope of the invention.

The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus or method.

The word "exemplary" is used herein to mean serving as an example, instance, or illustration. Any embodiment described herein as "exemplary" is not necessarily to be construed as preferred or advantageous over other embodiments. Likewise, the term "embodiment" of an apparatus, method or article of manufacture does not require that all embodiments of the invention include the described components, structure, features, functionality, processes, advantages, benefits, or modes of operation.

Any reference to an element herein using a designation such as "first," "second," and so forth does not generally limit the quantity or order of those elements. Rather, these designations are used herein as a convenient method of distinguishing between two or more elements or instances of an element. Thus, a reference to first and second elements does not mean that only two elements can be employed, or that the first element must precede the second element.

As used herein, the terms "comprises," "comprising," "includes," and/or "including," when used herein, specify the presence of the stated features, integers, steps, operations, elements, and/or components, but do not preclude the presence or addition of one or more other features, integers, steps, operations, elements, components, and/or groups thereof.

In the following detailed description, various aspects of the present invention will be presented in the context of apparatuses and methods to manipulate a fastener in conjunction with a hard disk drive (HDD). However, those skilled in the art will realize that these aspects may be extended to any suitable application where it is desirable to manipulate a fastener, such as a screw, in conjunction with a work piece. Accordingly, any reference to a process for manipulating a fastener of an HDD is intended only to illustrate the various aspects of the present invention, with the understanding that such aspects may have a wide range of applications.

Aspects of an apparatus for driving fasteners include a rotatable bit having a bit tip mateable with a fastener, a vacuum source, and a rotatable sleeve having an outlet in communication with the vacuum source. The bit may be press fit within the sleeve such that the bit and the sleeve are rotatable together.

Aspects of a method of rotating a fastener with an apparatus for driving fasteners, the apparatus for driving fasteners having a rotatable bit having a bit tip, and a rotatable sleeve having an outlet, wherein the bit is press fit within the sleeve such that the bit and the sleeve are rotatable together, the method including providing a vacuum to the outlet of the sleeve, engaging the bit tip and the sleeve with the head of the screw with assistance from the vacuum, and rotating the bit, thereby rotating the sleeve and the fastener.

Figure 2:
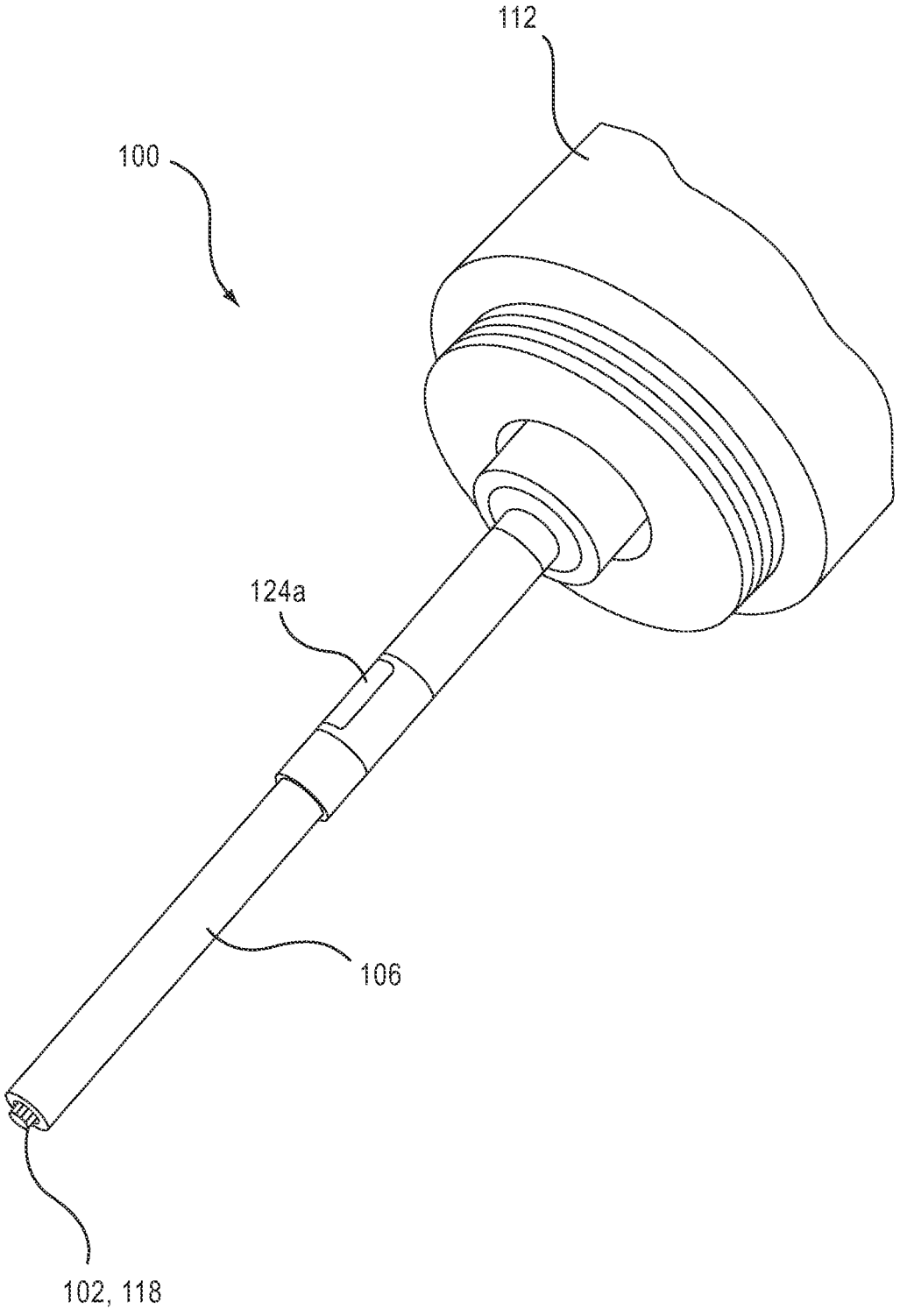
FIG. 2 is a perspective view of the exemplary embodiment of the apparatus for driving fasteners of FIG. 1 with a vacuum block omitted.
Figure 3:
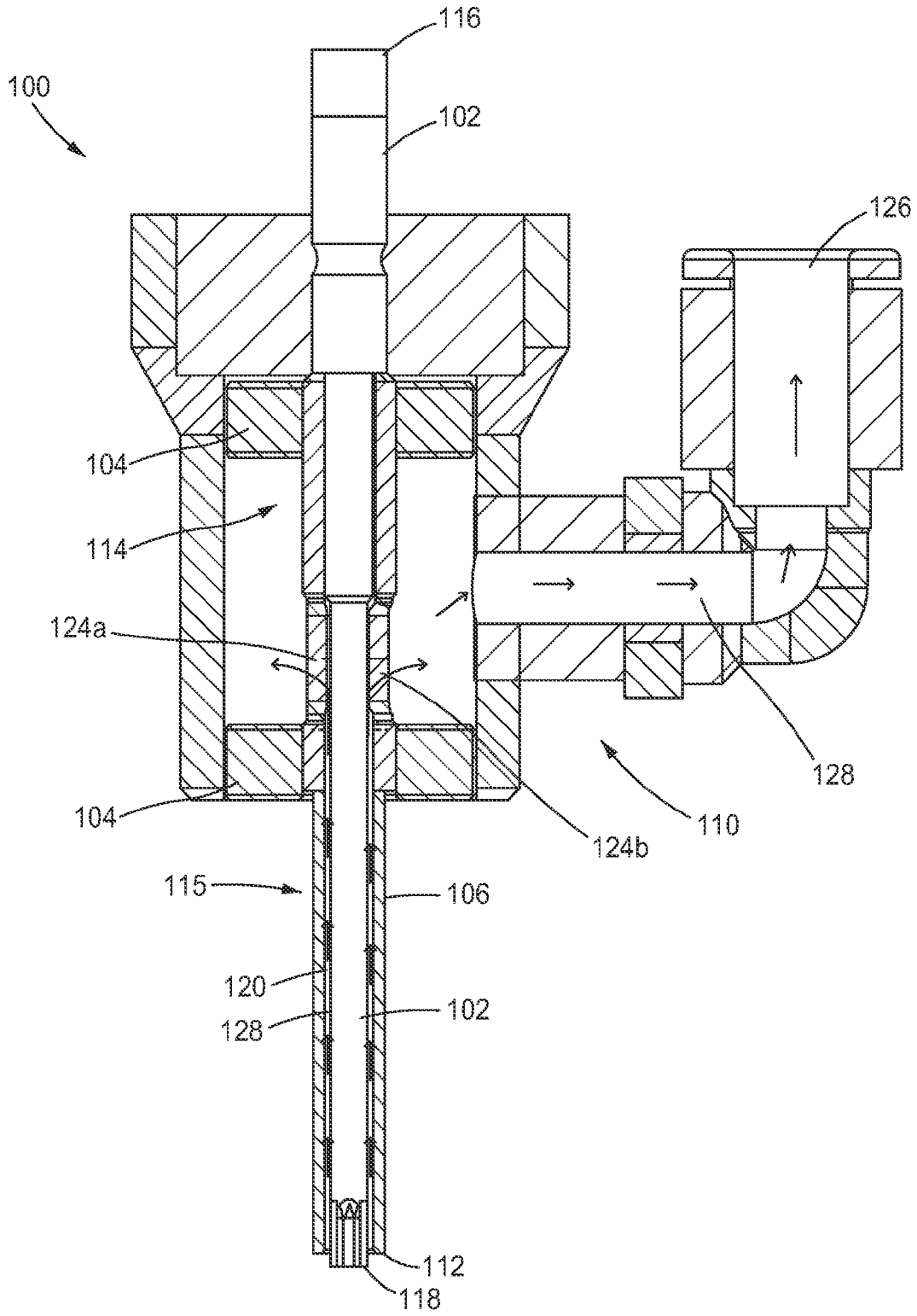
FIG. 3 is cross sectional view of the exemplary embodiment of the apparatus for driving fasteners of FIG. 1 with a driver omitted.

FIG. 1 is a perspective view of an exemplary embodiment of an apparatus for driving fasteners 100. FIG. 2 shows a perspective view of the operating end of the apparatus for driving fasteners 100 of FIG. 1, with the vacuum block omitted. The apparatus for driving fasteners 100 may generally include a bit 102 coupled with a sleeve 106, a driver 112 coupled with bit 102, and a vacuum block 110 coupled with the sleeve 106 via bearings 104 (FIG. 3). The vacuum block may 110 may be in communication with a vacuum source via a vacuum tube 111.

FIG. 3 is a cross sectional view of the apparatus for driving fasteners 100 of FIG. 1, with the driver omitted. As shown in FIG. 3, the bit 102 may be press fit into sleeve 106. In the exemplary embodiment shown, only a portion of the bit 102 is press fit into the sleeve 106. For example as shown in FIG. 3, the bit 102 may be press fit into the sleeve 106 along the portion 114. The portion 114 may be located near the driver 112 (FIG. 2) and within the vacuum block 110. The press fitting of the bit 102 with the sleeve 106 may couple the motion of the bit 102 with the sleeve 106. Thus, due to the press fitting, rotation of the bit 102 may also impart rotation of the sleeve 106.

The bit 102 may have a first end 116 coupled with the driver 112 and a second end 118 extending out of the sleeve 106. The second end 118 is also referred herein as a bit tip. Once the bit 102 and sleeve 106 are coupled by press fitting in the portion 114, a gap may be included between the outer diameter of the bit 102 and inner diameter of the sleeve, forming a vacuum channel 120. Thus, the inner diameter of the sleeve 106 may be greater than the diameter of the bit 102. In other words, the channel 120 may be located in a non-pressed fit portion 115. As shown in FIG. 1, the bit tip 118 may protrude beyond an outlet 122 of the sleeve 106. The distance that the bit tip 118 protrudes beyond the outlet 122 of the sleeve 106 may be referred to as a screw engagement length.

The sleeve 106 may have a plurality of openings 124*a*, 124*b* that may be connected to the channel 120 for an air vacuum to flow through (e.g., to provide a vacuum path). The openings 124*a*, 124*b* may diametrically oppose one another around the circumference of the bit 102. The openings 124*a*, 124*b* may be located within the vacuum block 110. The openings 124*a*, 124*b*, may delineate the press fit portion 114 from the non-press fit portion 115. In other words, the press fit portion 114 may define an area from the driver 112 to the openings 124*a*, 124*b*, while the non-press fit portion may define an area from the openings 124*a*, 124*b* to the outlet 122 of the sleeve 106.

As shown in FIGS. 1, 2, and 3, the vacuum block 110 may be mounted to the sleeve 106 via the bearings 104. The vacuum block 110 may include a vacuum inlet port 126 that is in communication with the vacuum tube 111. The vacuum inlet port 126 may connect to the vacuum path (arrows 128) through the openings 124*a*, 124*b* in the sleeve 106. The vacuum path 128 may be defined by the path from the vacuum source, to the vacuum inlet port 126, to the openings 124*a*, 124*b* in the sleeve 106, and to the channel 120 between the bit 102 and the sleeve 106. While the vacuum block 110 may be mounted directly to the apparatus for driving fasteners as shown in FIGS. 1 and 2, in another exemplary embodiment, the vacuum block may not be mounted to the apparatus for driving fasteners.

Once vacuum flow is applied to the channel 120, the apparatus for driving fasteners 100 may be used to pick up and hold a fastener 130. In an example embodiment, the fastener may be a screw. However, it should be appreciated that the apparatus for driving fasteners may be operated to interact with a variety of fasteners including bolts, pins, nails, tacks, spikes, rivets, brads, studs, and the like. Thus, it should be appreciated that the use of term "fastener" or "screw" herein may refer to any suitable fastener.

The operator (or automated machine) may direct the apparatus for driving fasteners 100 such that the bit tip 118 approaches the head 132 of the fastener 130. Once the bit tip 118 is sufficiently close to the fastener head 132 (e.g., a screw head), the fastener 130 (e.g., a screw) will be sucked toward the bit tip 118 and the sleeve 106 via the vacuum. The bit tip 118 will then enter the head 132 of the fastener 130 at the center of the fastener 130 (e.g., enter the bit receiving portion of the fastener), while the sleeve 106 contacts the portion of the head 132 of the fastener 130 surrounding the bit receiving portion of the fastener.

Figure 4:
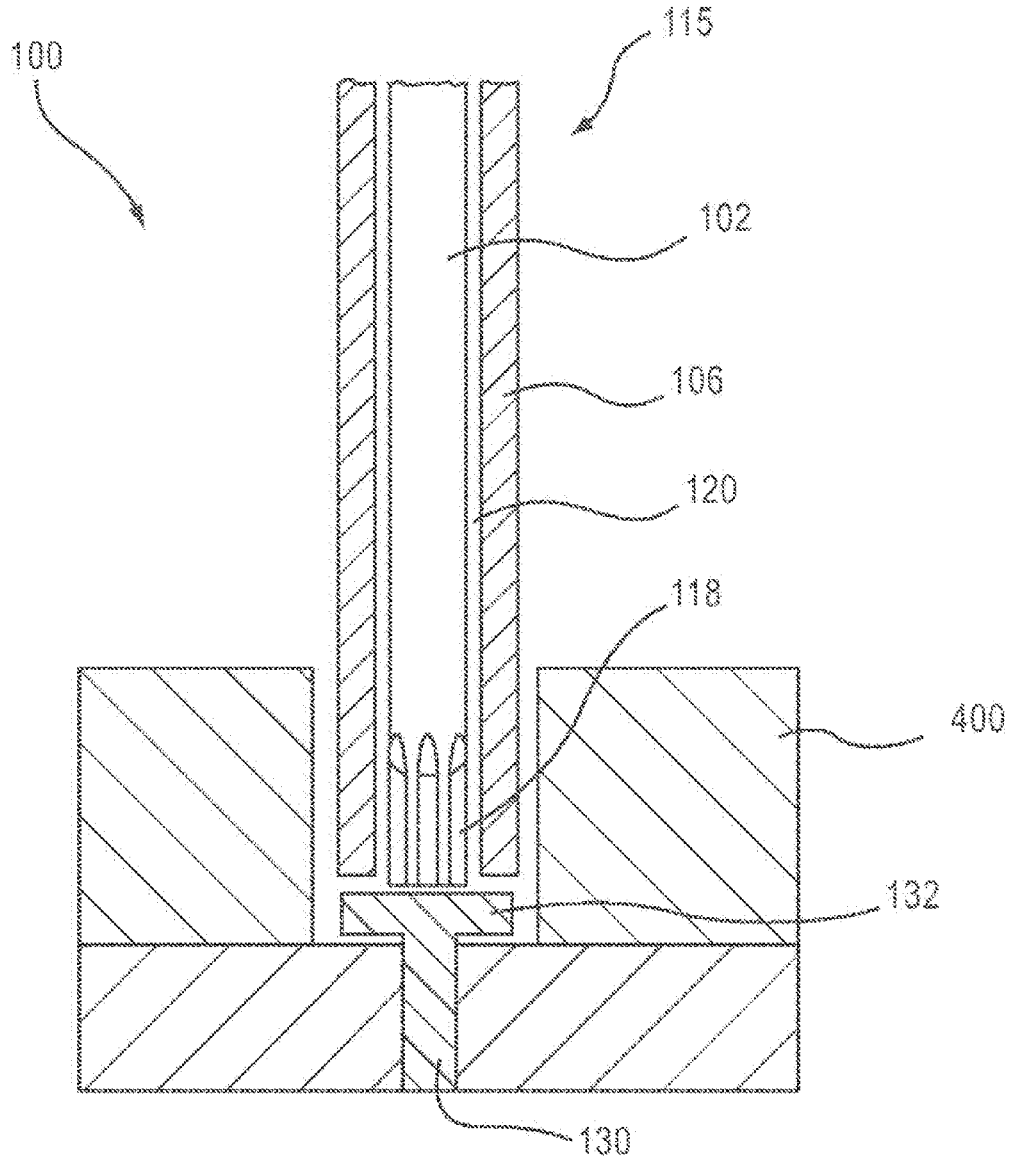
FIG. 4 is a cross section view of a bit tip end of the exemplary embodiment of the apparatus for driving fasteners of FIG. 1 in conjunction with a work piece.
Figure 5:
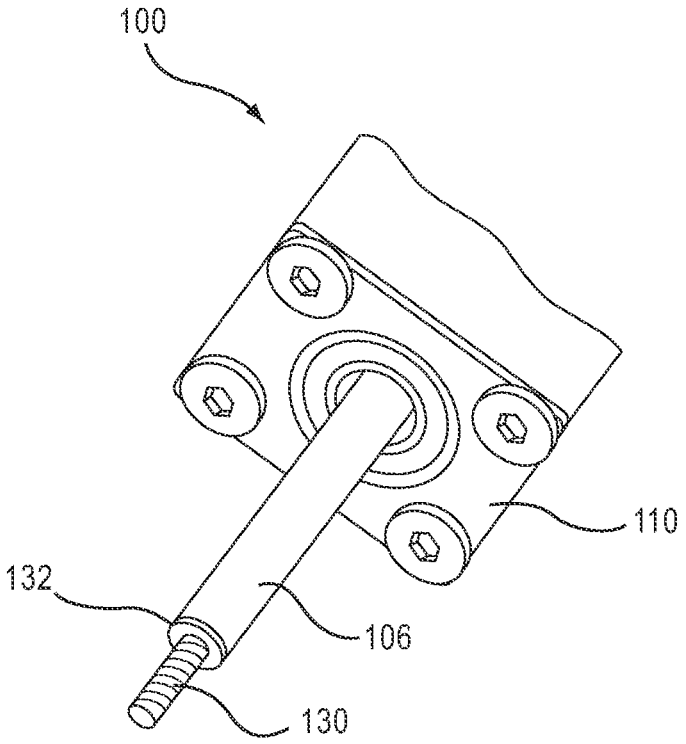
FIG. 5 is a perspective view of the bit tip end of the exemplary embodiment of the apparatus for driving fasteners of FIG. 1 engaged with a fastener.

The interaction between the bit 102/sleeve 106 and the fastener 130 is best shown in FIGS. 4 and 5. FIG. 4 shows a cross section view of the bit tip end of the apparatus for driving fasteners 100 of FIG. 1 in conjunction with a work piece 1400. FIG. 5 shows a perspective view of the fastener driving tool of FIG. 1 engaged with the fastener 130. Because the vacuum causes the fastener head 132 to press against the sleeve 106, the sleeve 106 and vacuum combination is able to provide support to the fastener head 132 ensuring that the fastener 130 remains straight when picked up, as shown in FIG. 5.

The operator (or automated machine) may then rotate the bit 102, such as by manually actuating a driver 112 coupled with the bit 102 or by activating a power driver coupled with the bit. Because the bit 102 is press fit with the sleeve 106, the rotation of the bit 102 also imparts rotation on the sleeve 106. In this manner, during rotating of the fastener (e.g., screwing or unscrewing of a screw), even though the fastener head 132 is in contact with the sleeve 106, because sleeve 106 and fastener 130 rotate together (the fastener rotating via connection with the bit tip 118), there is little or no scratching of the fastener head 132 against the sleeve 106. Thus, contamination caused by metal particles, as compared to a screw driving tool having a screw finder, is reduced or is eliminated entirely.

The sleeve may provide sufficient support for the screw while minimizing thickness, thereby allowing for insertion into small areas. Because there is no screw finder around the bit, other than the sleeve, the space around the bit is empty. This allows the apparatus for driving fasteners to operate in smaller locations, with smaller fasteners, in a smaller space and deeper part of the work piece, as compared to a screw driving tool having a screw finder, while maintaining a straight screw without scratching.

In an exemplary embodiment, because the fastener head 132 contacts the rotating sleeve 106 that surrounds the bit 102, the overall thickness of the operating end of the apparatus for driving fasteners 100 is minimized. As shown in FIGS. 4 and 5, in an exemplary embodiment, the overall outer diameter of the sleeve 106 may be as small as the diameter of the fastener head 132. Thus, in an exemplary embedment, the overall outer diameter of the sleeve 106 may be about the same diameter of the fastener head 132. For example, the outer diameter of the sleeve may be about 4 mm for a fastener with a 4 mm diameter head (e.g., a 4 mm screw). Similarly, the outer diameter of the sleeve may be about 2 mm for a fastener with a 2 mm diameter head (e.g., a 2 mm screw). In an exemplary embodiment, some amount of clearance may be desired when operating the apparatus for driving fasteners. For example, the desired clearance may be about 0.2 to 0.5 mm. Thus, for a fastener with a 2 mm head, the apparatus for driving fasteners may operate in a space within a work piece 200 of about 2.2 to 2.5 mm, and for a fastener having a 2 mm head, the apparatus for driving fasteners may operate in a space within the work piece 200 of about 4.2 to 4.5 mm or larger.

Figure 6A:
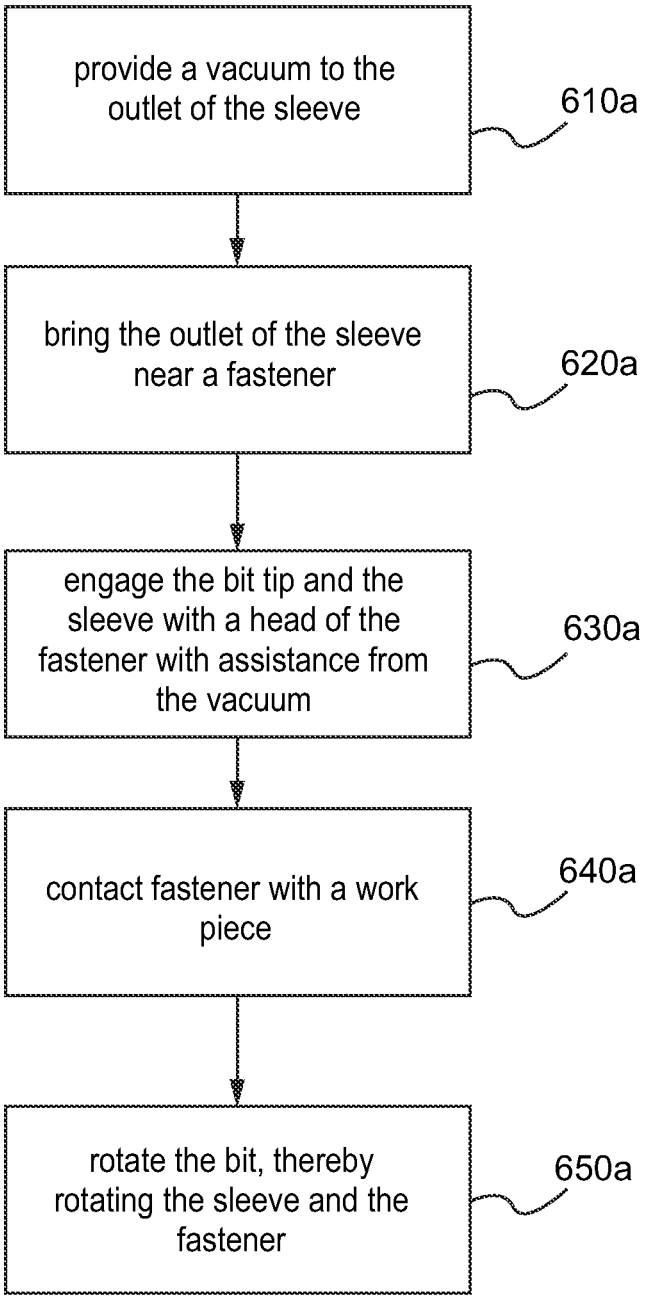
FIG. 6*a* is a flowchart of an exemplary embodiment of a method of rotating a fastener with an apparatus for driving fasteners.

FIG. 6*a* is a flowchart of a method of rotating a fastener with the above-described apparatus for driving fasteners. The method shown in FIG. 6*a* is for fastening the fastener into a work piece. As shown in FIG. 6*a*, the method may begin at step 610*a* where a vacuum is provided to the outlet of the sleeve. As noted above, the vacuum may be applied to the sleeve by coupling a vacuum block to the sleeve, and coupling the vacuum block with a vacuum source via a tube. With the vacuum running, the method may proceed to step 620*a* where the operator (or automated machine) brings the outlet of the sleeve near a fastener. Because the method of FIG. 6*a* is for fastening the fastener into a work piece, the fastener may be free from engagement with a work piece (i.e., is loose on a table or loosely resting in a fastener holder) prior to step 620*a*. After step 620*a*, the method may proceed to step 630*a* where the operator engages the bit tip and the sleeve with a head of the fastener with assistance from the vacuum. In step 630*a*, the middle portion of the head may be engaged with the bit tip (e.g., the bit tip enters into a receiving portion of the head of the fastener) and the fastener is securely held in place against the sleeve due to the vacuum suction. Because the fastener is not engaged with the work piece at the time of performing step 630*a*, the vacuum may lift up the fastener from its resting place to engage the fastener with the bit tip/sleeve. Then, the method proceeds to step 640*a*, where the operator contacts the fastener with a work piece. For example, the operator may align the fastener with a threaded hole in the work piece. Next, the method proceeds to step 650*a*, where the operator rotates the bit, thereby rotating the sleeve and the fastener. As noted above, the rotating the bit will also rotate the sleeve because of the press fitting between the bit and the sleeve. Step 650*a* may include actuating the driver to rotate the bit. As the fastener rotates the operator may apply a force in the direction toward the work piece. In this manner, the fastener will engage the work piece. For example, when fastener is aligned with a threaded hole in the work piece, the combined rotation and force will cause the fastener to move deeper within the hole of the work piece.

Figure 6B:
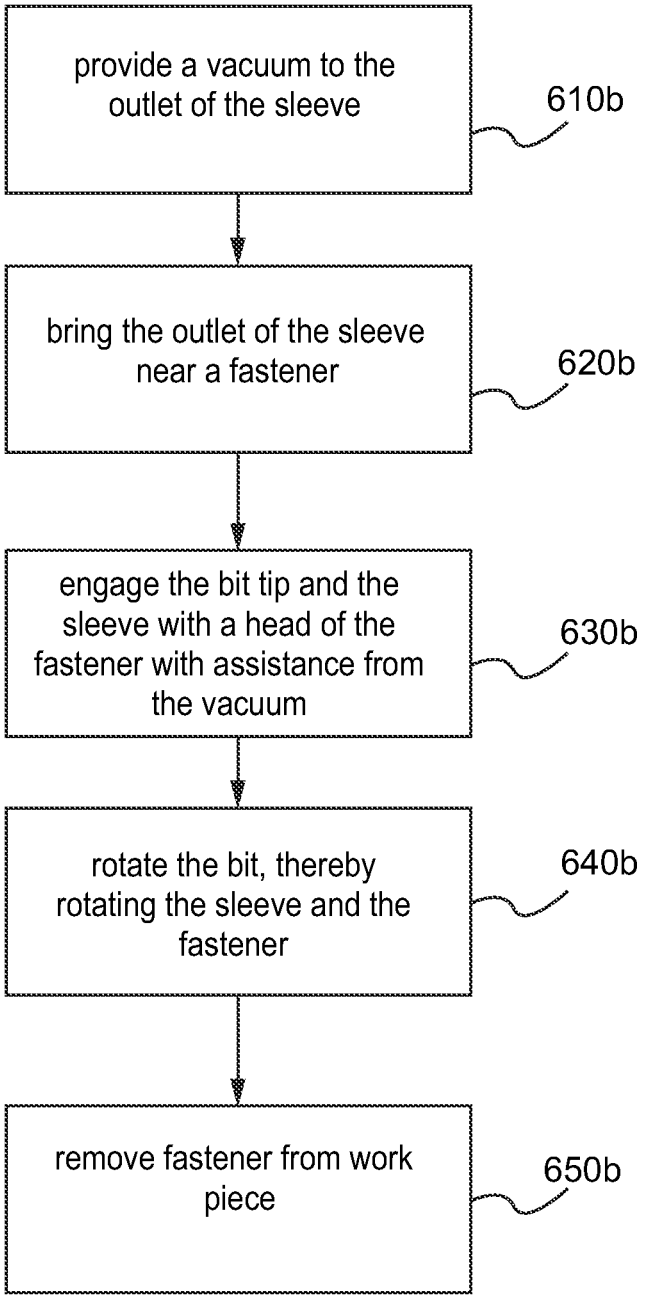
FIG. 6*b* is a flowchart of an exemplary embodiment of a method of rotating a fastener with an apparatus for driving fasteners.

FIG. 6*b* is a flowchart of a method of rotating a fastener with the above-described apparatus for driving fasteners. The method shown in FIG. 6*b* is for removing a fastener from a work piece. As shown in FIG. 6*b*, the method may begin at step 610*b* where a vacuum is provided to the outlet of the sleeve. As noted above, the vacuum may be applied to the sleeve by coupling a vacuum block to the sleeve, and coupling the vacuum block with a vacuum source via a tube. With the vacuum running, the method may proceed to step 620*b* where the operator (or automated machine) brings the outlet of the sleeve near a fastener. Because the method of FIG. 6*b* is for removing the fastener from a work piece, the fastener may be engaged with a work piece prior to step 620*b* (i.e., is already being used to fasten a work piece). After step 620*b*, the method may proceed to step 630*b* where the operator engages the bit tip and the sleeve with a head of the fastener with assistance from the vacuum. In step 630*b*, the middle portion of the head may be engaged with the bit tip (e.g., the bit tip enters into a receiving portion of the head of the fastener) and the fastener is securely held in place against the sleeve due to the vacuum suction. Because the fastener is engaged with the work piece at the time of performing step 630*b*, the vacuum will not yet lift the fastener, but will assist the operator in properly engaging the fastener with the bit tip/sleeve and retaining control of the fastener as soon as it is free from the work piece. Next, the method proceeds to step 640*b*, where the operator rotates the bit, thereby rotating the sleeve and the fastener. As noted above, the rotating the bit will also rotate the sleeve because of the press fitting between the bit and the sleeve. Step 640*b* may include actuating the driver to rotate the bit. Then, the method proceeds to step 650*b*, where the operator removes the fastener with a work piece. As the fastener rotates the operator may apply a force in the direction away the work piece. In this manner, the fastener will disengage from work piece. For example, when the fastener is initially inserted with a threaded hole in the work piece, the combined rotation and force will cause the fastener to move out of the hole of the work piece. Due to the vacuum, as soon as the fastener is free from the work piece, the fastener will remain securely held by the apparatus for driving fasteners. The operator can release the fastener by terminating the vacuum.

The various aspects of this disclosure are provided to enable one of ordinary skill in the art to practice the present invention. Various modifications to exemplary embodiments presented throughout this disclosure will be readily apparent to those skilled in the art, and the concepts disclosed herein may be extended to other devices. Thus, the claims are not intended to be limited to the various aspects of this disclosure, but are to be accorded the full scope consistent with the language of the claims. All structural and functional equivalents to the various components of the exemplary embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112(f) unless the element is expressly recited using the phrase "means for" or, in the case of a method claim, the element is recited using the phrase "step for."

The invention claimed is:

1. An apparatus for driving fasteners comprising:

a vacuum source;

a vacuum block having an inlet port;

a driver;

a rotatable bit having a first portion coupled with the driver and a second portion having a bit tip mateable with a fastener;

a rotatable sleeve having a first portion, wherein the first portion of the rotatable bit is press fit within the first portion of the rotatable sleeve; and a vacuum channel formed between a second portion of the rotatable sleeve and the second portion of the rotatable bit, wherein the rotatable sleeve further comprises an opening in communication with the vacuum source and with the vacuum channel;

wherein the first portion of the rotatable sleeve is rotatably coupled with the vacuum block;

wherein the second portion of the rotatable sleeve defines an outlet in communication with the vacuum source through the vacuum channel, the opening and the inlet port providing a vacuum to engage the fastener to the outlet;

wherein the bit tip extends out of the outlet of the rotatable sleeve.

2. The apparatus of claim 1, wherein the vacuum block has a vacuum input line in communication with the outlet of the rotatable sleeve and the vacuum source.

3. The apparatus of claim 2, further comprising one or more bearings surrounding the rotatable sleeve, wherein the vacuum block is coupled to the rotatable sleeve via the one or more bearings.

4. The apparatus of claim 1, wherein the vacuum channel extends from the opening to the outlet.

5. The apparatus of claim 1, wherein the rotatable sleeve is operable with a fastener having a head diameter substantially equal to an outer diameter of the rotatable sleeve.

6. The apparatus of claim 5, wherein the outer diameter of the rotatable sleeve is from about 2.0 mm to about 4.0 mm.

7. A method of rotating a fastener with an apparatus for driving fasteners, the apparatus comprising a rotatable bit having a bit tip, and a rotatable sleeve having an outlet, wherein the bit is press fit within the rotatable sleeve such that the bit and the rotatable sleeve are rotatable together, the method comprising:

providing a vacuum source, a vacuum block having an inlet port, and a driver, wherein the rotatable bit has a first portion and the rotatable sleeve has a first portion coupled with the driver, wherein the first portion of the rotatable bit is press fit within the first portion of the rotatable sleeve;

forming a vacuum channel between a second portion of the rotatable sleeve and a second portion of the rotatable bit, wherein the rotatable sleeve further comprises an opening in communication with the vacuum source and with the vacuum channel, wherein the first portion of the rotatable sleeve is rotatably coupled with the vacuum block and the second portion of the rotatable sleeve defines the outlet in communication with the vacuum;

providing a vacuum to the outlet of the rotatable sleeve through the vacuum channel, the opening and the inlet port;

engaging the bit tip and the outlet of the rotatable sleeve to a head of the fastener with assistance from the vacuum, wherein the bit tip extends out of the outlet of the sleeve; and rotating the bit, thereby rotating the rotatable sleeve and the fastener.

8. The method of claim 7, wherein the vacuum is provided to the outlet of the rotatable sleeve by the vacuum block through a vacuum input line.

9. The method of claim 8, wherein the driver is coupled to the vacuum block.

10. The method of claim 8, wherein the apparatus further comprises one or more bearings surrounding the rotatable sleeve, and wherein the vacuum block is coupled to the rotatable sleeve via the one or more bearings.

11. The method of claim 7, wherein the channel extends from the opening to the outlet.

12. The method claim 7, wherein an outer diameter of the rotatable sleeve is substantially equal to a diameter of a head of the fastener.

13. The method of claim 12, where the outer diameter of the rotatable sleeve is from about 2.0 mm to about 4.0 mm.

* * * * *